US008613633B2

(12) United States Patent
Pachon et al.

(10) Patent No.: US 8,613,633 B2
(45) Date of Patent: Dec. 24, 2013

(54) ELECTRICAL CONNECTOR

(75) Inventors: Arturo Pachon, Badalona (ES); Antonio Puell Olle, Barcelona (ES); Didier Claeys, Schaffen (BE)

(73) Assignees: Tyco Electronics Amp Espana Sau, Barcelona (ES); Tyco Electronics Raychem BVBA, Kessel-Lo (BE)

( * ) Notice: Subject to any disclaimer, the term of this patent is extended or adjusted under 35 U.S.C. 154(b) by 81 days.

(21) Appl. No.: 13/419,257

(22) Filed: Mar. 13, 2012

(65) Prior Publication Data

US 2012/0238153 A1 Sep. 20, 2012

(30) Foreign Application Priority Data

Mar. 16, 2011 (EP) ..... 11382071

(51) Int. Cl.
*H01R 4/24* (2006.01)

(52) U.S. Cl.
USPC ..... 439/620.11; 439/620.23

(58) Field of Classification Search
USPC ..... 439/620.11, 620.23, 620.17, 620.18, 439/409
See application file for complete search history.

(56) References Cited

U.S. PATENT DOCUMENTS

| | | | | |
|---|---|---|---|---|
| 5,947,761 | A | 9/1999 | Pepe | |
| 6,227,911 | B1 * | 5/2001 | Boutros et al. | 439/620.18 |
| 6,641,440 | B1 * | 11/2003 | Walker et al. | 439/620.17 |
| 6,702,618 | B1 * | 3/2004 | Hyland et al. | 439/620.23 |
| 7,153,163 | B2 * | 12/2006 | Lewis et al. | 439/620.11 |
| 7,351,083 | B2 * | 4/2008 | Biddle et al. | 439/188 |
| 7,443,056 | B2 * | 10/2008 | Fisher et al. | 307/116 |
| 7,540,760 | B1 | 6/2009 | Chen | |
| 7,611,383 | B1 * | 11/2009 | Huang | 439/620.17 |
| 7,833,062 | B2 * | 11/2010 | Zhou et al. | 439/620.23 |
| 8,376,787 | B2 * | 2/2013 | Panella et al. | 439/676 |
| 2003/0087555 | A1 * | 5/2003 | Korsunsky et al. | 439/620 |
| 2003/0211782 | A1 * | 11/2003 | Esparaz et al. | 439/620 |
| 2004/0082223 | A1 * | 4/2004 | Hyland et al. | 439/620 |
| 2004/0110422 | A1 * | 6/2004 | Sasai et al. | 439/620 |
| 2004/0142592 | A1 | 7/2004 | Peng | |
| 2006/0014410 | A1 | 1/2006 | Caveney | |
| 2011/0028026 | A1 | 2/2011 | Lu | |

OTHER PUBLICATIONS

European Search Report for Application No. 11382071.6 mailed Sep. 1, 2011.

* cited by examiner

*Primary Examiner* — Gary Paumen
(74) *Attorney, Agent, or Firm* — Merchant & Gould P.C.

(57) ABSTRACT

An electrical connector for terminating a plurality of line wires of communications cable which comprises a dielectric housing; a terminal insert, a contact subassembly and a wire fixture, and a polarization circuit fully covered by the wire fixture it is in a closed or working position.

21 Claims, 5 Drawing Sheets

ELECTRICAL CONNECTOR

CROSS-REFERENCE TO RELATED APPLICATIONS

The present application claims priority from European Patent Application No. 11382071, filed Mar. 16, 2011, the disclosure of which is hereby incorporated by reference in its entirety.

FIELD OF INVENTION

This invention refers to an electrical connection including IDC insulation displacement contacts and a cover which includes a fixture for holding wires of a communications cable in proper position for the termination of the contacts.

BACKGROUND

An electrical connector is known in the state of the art, for example, from U.S. Pat. No. 5,947,761 for use in data communications systems having insulation displacement contacts IDC. The electrical connector receives a communications cable including a set of individually insulated wires which are set in the corresponding IDC contacts of the electrical connector.

The electrical connector also includes a dielectric housing, a terminal insert, a contact subassembly and a wire fixture for retaining the communications cable in an appropriate position for termination of the electrical connector.

The terminal insert includes a printed circuit board that cooperates with the IDC insulation displacement contacts, in order to electrically connect the line wires with the respective terminals.

The contact subassembly includes a contact dielectric holder which holds a plurality of insulation displacement contacts IDC these are generally aligned in rows parallel to the back part of the electrical connector, i.e., in proximity to the part of the wire fixture for which the communications cable enters the electrical connector.

The IDC contacts are designed to receive in each a line wire included in the communications cable. A wire insertion face is provided for receiving each of these wires and to plug in or subsequently connect in the posterior part of the connector proceeding to push each line wire into its respective IDC. The wire fixture of the cover makes a pivotal movement or a plugging movement of the line wires into the IDC contacts.

The cover comprises connection thrusters so that in their closing movement, they push and progressively approximate each line wire, through a lever effect, to its fully plugged in position in the posterior part of the electrical connector.

A disadvantage of the electrical connector or modular female socket is that it requires to connect an external circuit to the electrical connector to meet electrical functionalities such as to check voltage in the communications wires connected to the electrical connector and to verify the correct polarity of the connection made between the line wires and the IDC contacts or detecting presence/absence of connector at the far-end of the communication line. This external circuit complicates the installation practice adding time and cost as well as risk of failure while ease of application was the initial benefit of the connector.

There is therefore, a need to supply a modular female socket which includes IDC insulation displacement contacts and a cover which includes a wire fixture to retain the line wires of the communication cable and a checker circuit of the communication line connectivity to the electrical connector.

SUMMARY

This invention seeks to resolve one or more of the disadvantages described above by means of an electrical connector as described in the claims.

One object is to supply an electrical connector in order to terminate a plurality of line wires of a communications cable including a dielectric housing; a terminal insert, a contact subassembly and a wire fixture; where a tester circuit is configured to be assembled in a terminal insert and to verify the electric connection to make between the line wires and the IDC contacts included in the contact subassembly.

Another object is to provide an electrical circuit a type of tester or polarisation circuit connected electrically to a predetermined subset of IDC contacts, and to be assembled in a portion of a printed circuit board of the terminal insert.

A further object is to supply an electrical circuit which comprises a switching or contact breaker element and a resistive element electrically connected in series.

Another object is to permit the wire fixture in a closed or working position to fully cover the printed circuit assembled in the portion of the printed circuit board.

The electrical connector including the electrical circuit is inserted without using any tool, and consequently assembly faults are prevented, such as disconnection of the polarisation circuit. Furthermore, the time required for its termination and verification is lower than an electrical connector to which it is necessary to connect an external polarisation circuit.

The electrical connector module has a compact design, reduced and assembled in a single housing which prevents knocks, catching, and breakage of any component of the female electrical connector module.

In one example aspect, an electrical connector for terminating a plurality of line wires of a communications cable is disclosed. The electrical connector includes a dielectric housing, a terminal insert, a contact subassembly, and a wire fixture. The terminal insert includes a printed circuit board providing electrical tracks connecting between a contact subassembly and corresponding terminals. the printed circuit board is configured to receive an electrical circuit including one or more discrete circuit elements positioned within the housing of the electrical connector. The one or more discrete circuit elements are connected across a pair of wires included in the contact subassembly.

In a second example aspect, an electrical connector is disclosed that includes a connector housing having a receptacle portion sized to receive a plug. The electrical connector includes a circuit board including a plurality of terminals and corresponding locations to which insulation displacement contacts are mounted. The circuit board includes a plurality of tracks each electrically connecting a different one of the plurality of terminals to a corresponding location, and a polarization circuit electrically connected between two tracks and including a switching element electrically connected in series with a resistor. The electrical connector also includes a contact subassembly including a plurality of insulation displacement contacts mountable to the corresponding locations, and a wire fixture pivotally attached to the housing and movable between open and closed positions. The wire fixture is positioned to at least partially cover the circuit board in the closed position.

In a third example aspect, an electrical connector is disclosed that includes a connector housing and a circuit board positioned within the connector housing. The circuit board includes an electrical circuit mounted thereon. The electrical connector further includes a contact subassembly positioned above the circuit board within the connector housing and including a plurality of insulation displacement contacts mountable to the circuit board. The contact subassembly includes a horizontal U-shaped aperture rearward of the insulation displacement contacts and exposing at least a portion of the electrical circuit. The electrical connector also includes a wire fixture pivotally attached to the housing and movable between open and closed positions, wherein the wire fixture is positioned to at least partially cover the circuit board in the closed position.

BRIEF DESCRIPTION OF THE FIGURES

A more detailed explanation of the device according to the embodiments of the invention is set out below in the description that follows based on the attached figures, where.

DESCRIPTION OF EMBODIMENTS

Figure 1:
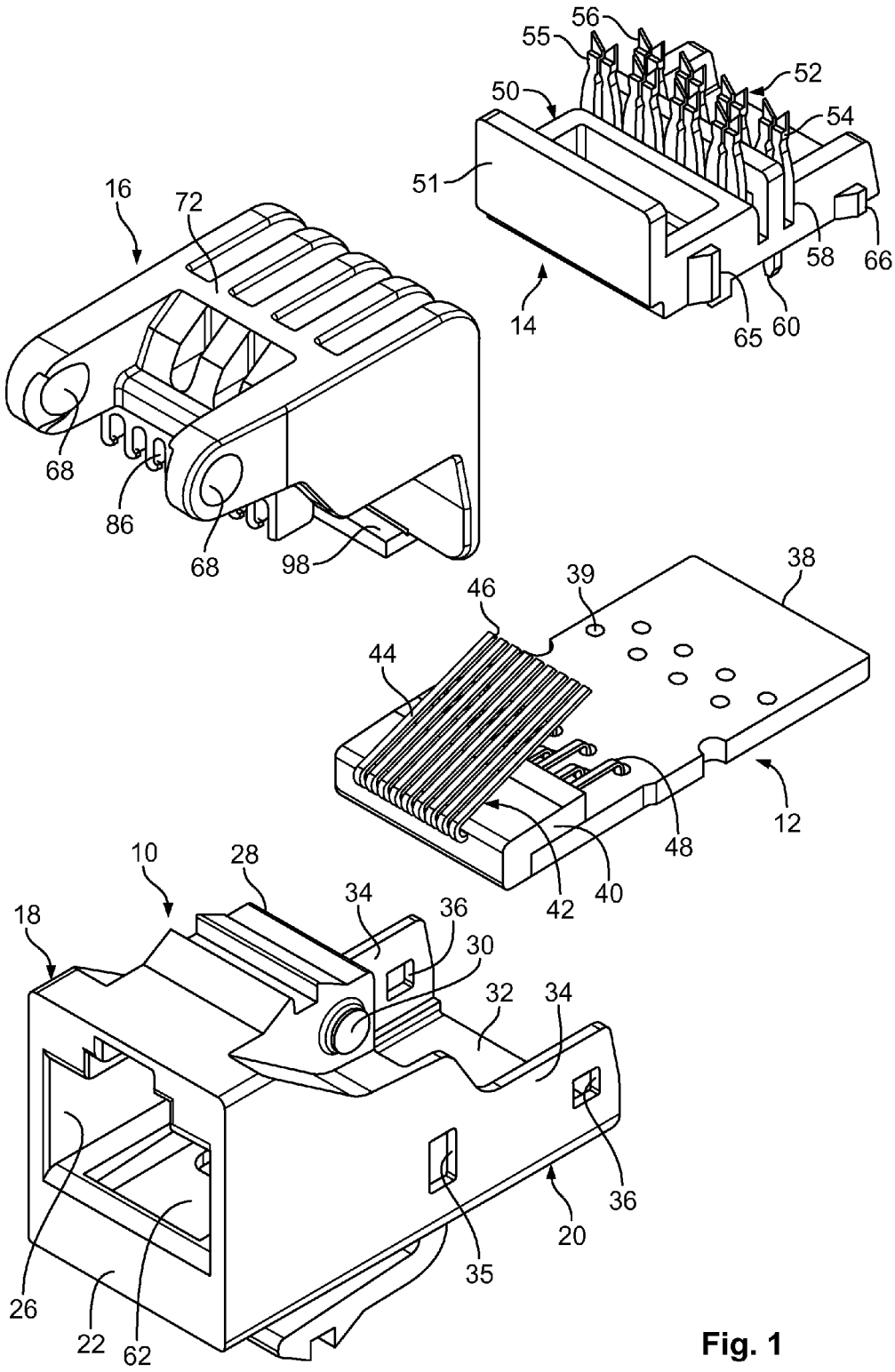
FIG. 1 shows an exploded isometric view of the connector known in the prior art.

In respect of FIG. 1, an electrical connector of the type female socket module knows in the state of the art from U.S. Pat. No. 5,947,761 incorporated by reference. The electrical connector includes a dielectric housing 10, a terminal insert 12, a contact subassembly 14, and a wire fixture 16.

The housing 10 includes a receptacle portion 18 and a platform portion 20. The receptacle portion has a front face 22, a rear face 24, and a cavity 26 which opens into the receptacle portion though the front face. The cavity is configured as a receptacle for a mating modular plug.

On top of the receptacle portion 18 is a pivot block 28 which has a pair of journals 30 extending from opposite sides thereof.

The platform portion 20 is disposed at a rear of the receptacle portion 18. The platform portion includes a bottom wall 32 and side walls 34 which have openings 35, 36.

The terminal insert 12 includes a circuit board 38 and a dielectric carrier 40 which holds a plurality of terminals 42 in an array. The terminals 42 have contact sections 44 which are adjacent to free ends 46, and opposite ends 48 which are electrically connected to circuit traces respectively imprinted on the printed circuit board.

The contact subassembly 14 includes a dielectric contact holder 50 which holds a plurality of insulation displacement contacts 52. Each of the contacts has a split beam which defines a slot 54 that can receive a wire. Edges of the split beam on opposite sides of the slot are configured to slice the insulation jacket on a wire which is installed in the slot and to electrically engage the wire conductive core of the respective line wire.

The contacts 52 are arranged in the holder in laterally extending rows comprising a first row 55 and a second row 56 which are spaced-apart along a longitudinal axis of the connector. The rows extend parallel to each other. The contact holder 50 includes a separator wall 58 between the two rows 55, 56 and is configured to electrically insulate the IDC contacts located on each row 55, 56.

Figure 2:
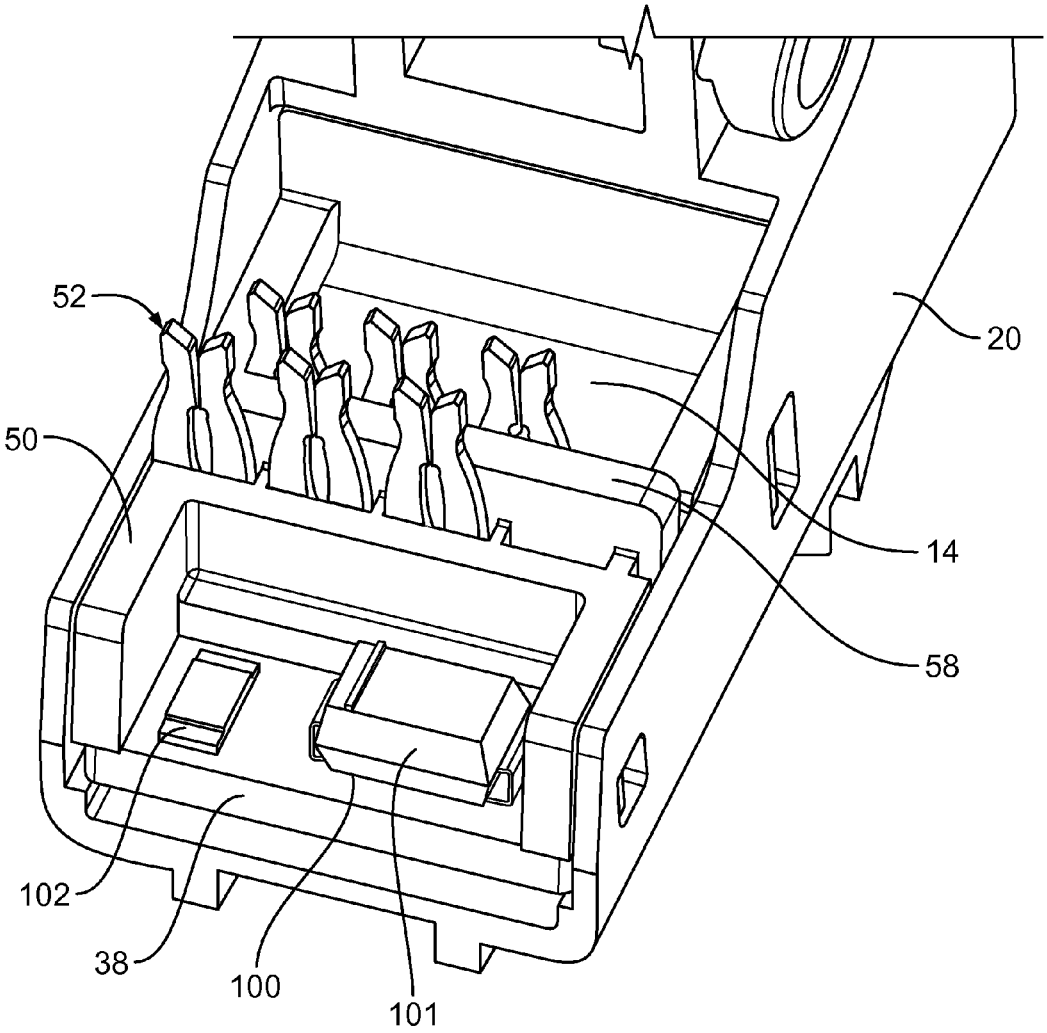
FIG. 2 shows a rear isometric view of the connector with a wire fixture in an open position.
Figure 3:
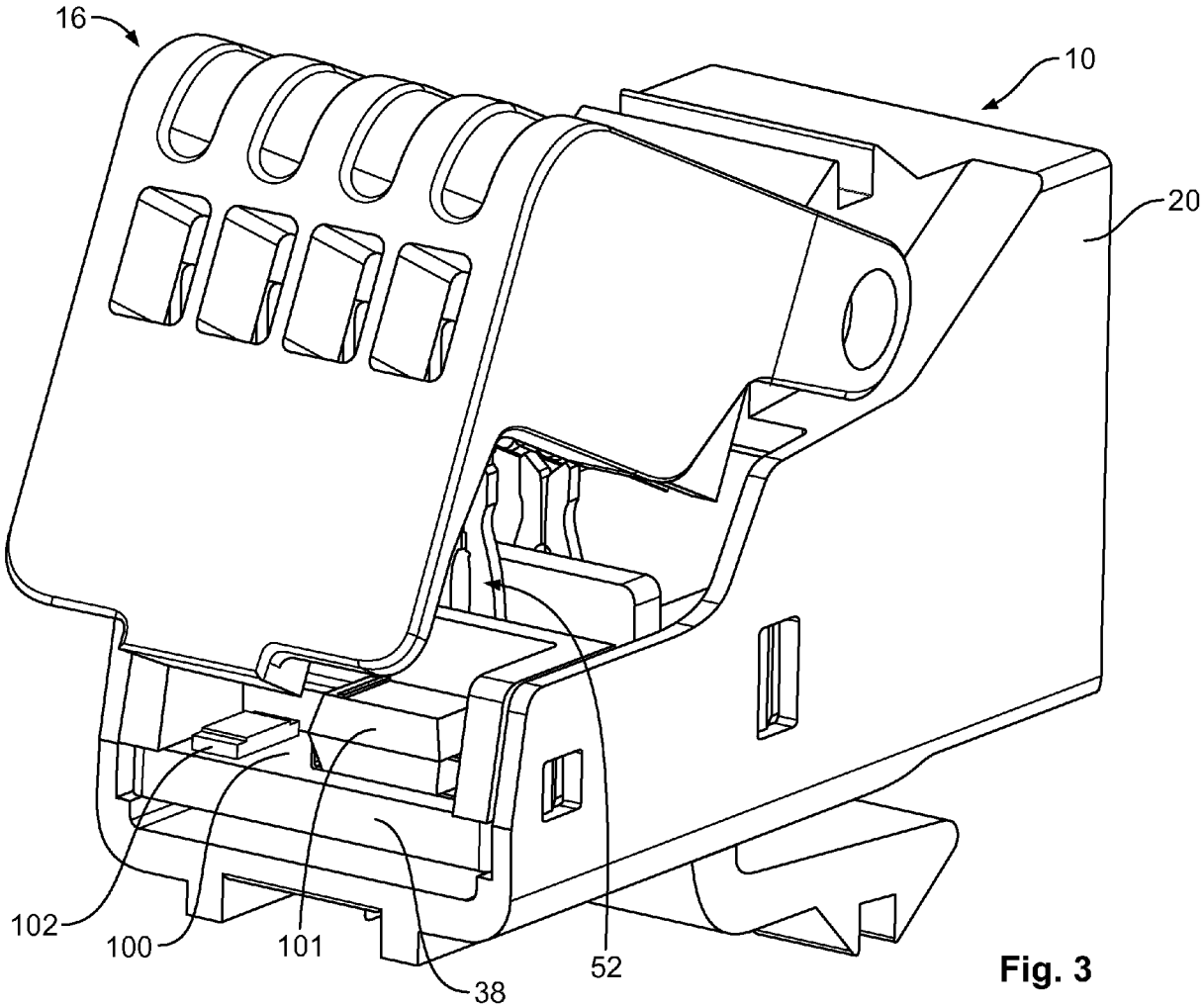
FIG. 3 shows a rear isometric view of the connector with a wire fixture in a partial closed position.

As best seen in FIGS. 2 and 3, the contact subassembly 14 includes a horizontal U-shaped aperture opened through the lower wall of the subassembly 14 and distanced from the furthest row of a wall 51, which faces a rear face 24 of the receptacle portion 18 and closes the terminals 42. The U-type aperture reveals part of the printed circuit board once the subassembly and the terminal insert 12 have been mounted in the dielectric housing 10.

Each of the contacts 52 has a solder tail 60 which is received in a through-hole 39 in the circuit board 38 and electrically terminated to a respective trace on the circuit board by soldering. In this way, the contacts 52 are electrically connected to respective ones of the terminals 42 by traces on the circuit board.

The circuit board 38 is configured to reside on the bottom wall 32 of the dielectric housing 10. The contact holder 50 has latch tabs 65, 66 which engage in the openings 35, 36, respectively, in the side walls of the platform section to secure the terminal insert and contact holder in the housing. The circuit board 38 includes tracks disposed thereon which electrically connect insulation displacement contacts 52 to the terminals 42. In various embodiments of the electrical connector discussed herein, varying numbers of terminals 42 and corresponding insulation displacement contacts 52 can be included. In example embodiments, four, six, or eight terminals 42 and corresponding insulation displacement contacts 52 can be included, representing two, three, or four differential signalling wire pairs. As such, in various embodiments, the electrical connector can receive plugs according to a number of format; in some embodiments, the electrical connector corresponds to an RJ-11 or RJ-45 jack, capable of receiving an RJ-11 or RJ-45 plug.

Figure 4:
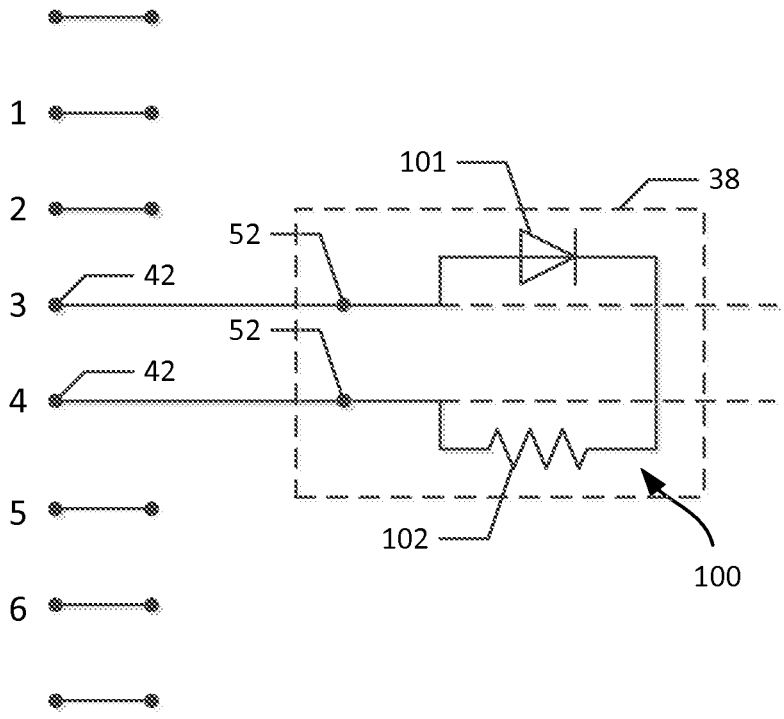
FIG. 4 shows an electrical circuit incorporated within the connector.

As mentioned above, the printed circuit board 38 is configured to receive an electrical circuit 100 in a portion of the printed circuit board. The electrical circuit 100 is a type of polarising circuit includes a resistive 102 element type resistance and a switching 101 element type diode, transistor, etc. The diode and the resistance are electrically connected in series and to respective tracks printed in the printed circuit board 100 connects, in turn, to IDC connectors 52, and predetermined terminals 42. An example schematic illustration of the electrical circuit 100 is illustrated in FIG. 4.

In the embodiment shown, the electrical circuit 100 disposed on the printed circuit board 38 resides within the housing 10. In the embodiment shown, the resistive element 102 and the switching element 101 are discrete circuit elements that are mounted to the printed circuit board 38, and are positioned rearward of the insulation displacement contacts 52. For example, the discrete circuit elements, including the resistive element 102 and switching element 101 as shown can be mounted to the circuit board 38 at a position within the horizontal U-shaped aperture opened through the lower wall of the subassembly 14. The resistive element 102 and the switching element 101 are, in this embodiment, in a position on the printed circuit board 38 that remains exposed when the contact holder 50 is positioned over the printed circuit board within the housing. In alternative embodiments, the electrical circuit 100 can be disposed in alternative locations within the housing.

The electrical circuit 100 is configured to be connected in parallel to the communication cable and made electrical checking in the same cable. The electrical circuit 100 is directly supplied through the own communication network.

The electrical circuit 100 is useable to detect that the electrical connector is present within a communication network.

In normal operation of the communication network, the electrical circuit 100 acts as an open circuit, because the switching element 101 (shown as a diode in FIG. 4) prevents current from passing across the tracks, thereby allowing signals to travel through the electrical connector unimpeded.

In a testing arrangement, a signal can be injected onto the tracks having an opposite polarity to traditional communications signals. For example, as illustrated in FIG. 4, a positive voltage track and a negative voltage track of a differential pair could receive a reversed polarity signal, which would, at the electrical circuit 100, cause current to pass through that electrical circuit, across the switching element 101 (i.e., the diode) and the resistive element 102. Accordingly, for troubleshooting connectivity between a signal source and the electrical connector, it is possible to do so in the absence of telecommunications equipment connected at the electrical connector by injecting such negative polarity signals into the network, targeted to the endpoint at which the electrical connector is located. By detecting a return current on the lines (or by activating some type of circuit based on the presence of current across the diode and resistor of the electrical circuit 100, it may be possible to readily determine that the electrical connector is correctly connected to a signal source.

In alternative embodiments, the electrical circuit 100 includes other types of discrete circuit elements mountable to the circuit board, for example, providing for compensation relating to crosstalk or return loss occurring within the electrical connector. This may be the case, for example, when two or more wire pairs are included in the electrical connector.

Figure 5:
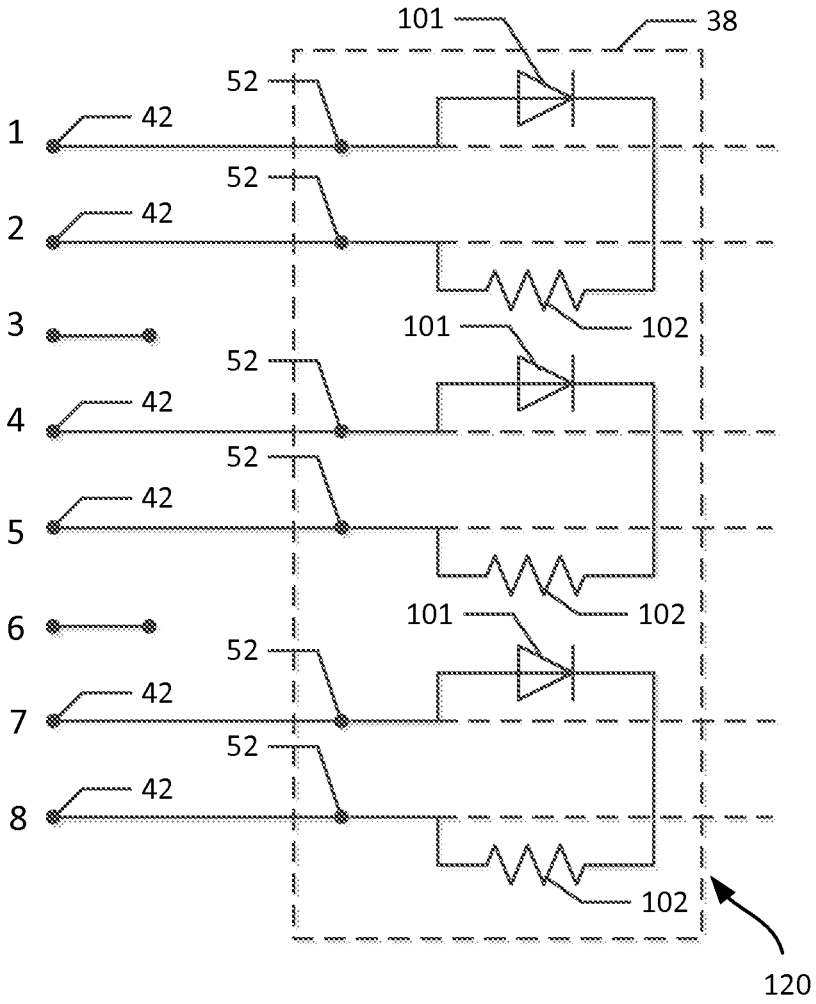
FIG. 5 shows a second possible electrical circuit incorporated within the connector.

In one alternative embodiment illustrated in FIG. 5, an electrical circuit 120 includes a plurality separate polarization circuits disposed across additional wire pairs in the electrical connector. In particular, in this embodiment, an eight wire electrical connector is used, in which the electrical pairs correspond to the first and second wires, third and sixth wires, fourth and fifth wires, and seventh and eighth wires, respectively. As illustrated, the electrical circuit 120 includes polarization circuits, including a switching element 101 (e.g., a diode) and resistive element 102, on each of the outside pairs (the 1-2 and 7-8 pairs) and a middle pair (in the embodiment shown, the 4-5 pair).

The wire fixture 16 is a dielectric member which is pivotally attached to the housing 10 by a yoke having two bores 68 which receive the journals 30 extending from the pivot block 28. The wire fixture 16 is pivotable from a full open position to a closed position.

In the working or closed position of the wire fixture 16, the electrical circuit 100 is protected from knocks and/or manipulation as it is covered completely by the wire fixture 16. In the open position of the wire fixture 16, the electrical circuit 100 is exposed for viewing and/or servicing, as well as for accessing the insulation displacement contacts 52.

The fixture 16 has a latch 98 which engages below the bottom wall 32 of the housing to retain the fixture in the closed working position.

The wire fixture 16 comprises a wire insertion face 70 along a rear wall, a topside 72 and an underside 74. The wire fixture 16 has passages 76 which are separated by walls 78. The passages 76 extend through the rear wall for a length downstream from the wire insertion face 70. The passages 76 are open along the underside 74 of the wire fixture for a significant portion of their length. Each of the passages has a cross-section which is dimensioned to receive a respective wires which are installed through the wire insertion face.

After being the wires positioned for insertion into the slots 54 of the insulation displacement contacts 52. Pivoting the wire fixture 16 to the closed position urges the wires into the slots 54 and into engagement with the insulation displacement contacts 52.

During the pivotal movement of the wire fixture 16, a significant force is required to push the wires into the slots 54. When the rotational movement has been completed, the latch 98 of the wire fixture 16 has coupled beneath the bottom wall 32 of the housing 10 retaining the fixture 16 in a closed position. Therefore the electrical connector has been inserted.

The invention claimed is:

1. An electrical connector for terminating a plurality of line wires of a communications cable, which comprises a dielectric housing; a terminal insert, a contact subassembly and a wire fixture; wherein the terminal insert includes a printed circuit board providing electrical tracks connecting between the contact subassembly and corresponding terminals, wherein the printed circuit board is configured to receive an electrical circuit including one or more discrete circuit elements positioned within the housing of the electrical connector, the one or more discrete circuit elements connected across a pair of wires included in the contact subassembly.

2. An electrical connector in accordance with claim 1, wherein the contact subassembly includes contacts of the type of insulation displacement contacts.

3. An electrical connector in accordance with claim 1, wherein the contact subassembly is configured to partially cover the printed circuit board.

4. An electrical connector in accordance with claim 1, wherein the contact subassembly is configured to fully cover the printed circuit board.

5. An electrical connector in accordance with claim 1, wherein the electrical circuit comprises a resistive element and a switching element electrically connected to check electrical connectivity of the wires of the communications cable electrically connected to the predetermined contacts subset.

6. An electrical connector in accordance with claim 5, wherein the resistive element and the switching element are electrically connected in series.

7. An electrical connector in accordance with claim 5, wherein electrical circuit is connected in parallel to the communication cable.

8. An electrical connector in accordance with claim 5, wherein the switching element is a type of diode, transistor.

9. An electrical connector in accordance with claim 5, wherein the resistive element is a resistance.

10. An electrical connector in accordance with claim 3, wherein the wire fixture in a closed or working position together to the dielectric housing is configured to define a closed housing or partially closed housing to allow the remaining components of the electrical connector.

11. An electrical connector in accordance with claim 1, wherein the electrical circuit is positioned within a horizontal U-shaped aperture opened through a lower wall of the contact subassembly.

12. An electrical connector comprising:

a connector housing having a receptacle portion sized to receive a plug;

a circuit board including a plurality of terminals and corresponding locations to which insulation displacement contacts are mounted, the circuit board including a plurality of tracks each electrically connecting a different one of the plurality of terminals to a corresponding location, the circuit board further including a polarization circuit electrically connected between two tracks and including a switching element electrically connected in series with a resistor;

a contact subassembly including a plurality of insulation displacement contacts mountable to the corresponding locations; and a wire fixture pivotally attached to the housing and movable between open and closed positions, wherein the wire fixture is positioned to at least partially cover the circuit board in the closed position.

13. The electrical connector of claim 12, wherein the two tracks comprise tracks of a wire pair.

14. The electrical connector of claim 13, wherein the circuit board includes at least second and third polarization circuits electrically connected between second and third wire pairs.

15. The electrical connector of claim 12, wherein the switching element includes a diode.

16. The electrical connector of claim 12, wherein the two tracks include a positive differential signalling track and a negative differential signalling track, and wherein during normal operation of the electrical connector the electrical circuit acts as an open circuit.

17. The electrical connector of claim 15, wherein, in a testing arrangement in which the electrical connector receives a signal of reversed polarity on the two tracks, the electrical circuit acts as a closed circuit across the two tracks.

18. The electrical connector of claim 12, wherein the electrical circuit is positioned within the housing and protected by the wire fixture in the closed position.

19. The electrical connector of claim 12, wherein the electrical circuit is positioned within a horizontal U-shaped aperture opened through a lower wall of the contact subassembly.

20. The electrical connector of claim 19, wherein the electrical circuit is positioned below the contact subassembly and is at least partially exposed by the horizontal U-shaped aperture.

21. An electrical connector comprising:

a connector housing;

a circuit board positioned within the connector housing, the circuit board further including an electrical circuit mounted thereon;

a contact subassembly positioned above the circuit board within the connector housing and including a plurality of insulation displacement contacts mountable to the circuit board, the contact subassembly including a horizontal U-shaped aperture rearward of the insulation displacement contacts and exposing at least a portion of the electrical circuit; and a wire fixture pivotally attached to the housing and movable between open and closed positions, wherein the wire fixture is positioned to at least partially cover the circuit board in the closed position.

* * * * *